United States Patent [19]

Richards et al.

[11] 4,414,920

[45] Nov. 15, 1983

[54] BLOCK FOR SUPPORTING THE POLES OF EQUESTRIAN FENCES

[76] Inventors: Peter K. Richards, Ballinaclash, Rathdrum, County Wicklow; Harry J. Hamilton, Amalurra, Newtownmountkennedy, County Wicklow, both of Ireland

[21] Appl. No.: 316,517

[22] Filed: Oct. 29, 1981

[30] Foreign Application Priority Data

Oct. 31, 1980 [IE] Ireland ..... 2267/80
Dec. 4, 1980 [IE] Ireland ..... 2537/80

[51] Int. Cl.[3] ..... A63K 3/00
[52] U.S. Cl. ..... 119/29
[58] Field of Search ..... 119/29; 272/102, 103, 272/113, 109; 46/27, 29

[56] References Cited

U.S. PATENT DOCUMENTS 4,199,138 4/1980 Kaiser ..... 272/113

FOREIGN PATENT DOCUMENTS 2161720 11/1971 France ..... 119/29
1561869 3/1980 United Kingdom .

*Primary Examiner*—Hugh R. Chamblee
*Attorney, Agent, or Firm*—Ostronlenk, Faber, Gerb & Soffen

[57] ABSTRACT

A block (1) for use in supporting one end of an equestrian fence pole. Each face (*2a,2a';2b,2b';2c,2c'*) of the block has a groove (*3a,3a';3b,3b';3c,3c'*) for receiving one end of a pole. The three dimensions of the block (1) are all different so that a pole can be supported at three different heights.

9 Claims, 3 Drawing Figures

BLOCK FOR SUPPORTING THE POLES OF EQUESTRIAN FENCES

BACKGROUND OF THE INVENTION

1. Field of the Invention

This invention relates to fences for equestrian sports.

2. Prior Art

A fence for equestrian sports comprises generally one or more horizontally extending poles, supported at each end.

The pole or poles may be supported by, for example, rigid pillars or posts or by empty oil barrels. If a horse should stumble or fall and the horse or rider hit such a pillar, post or barrel, serious injury may result. Stumbling or falling is particularly likely to occur with young horses undergoing training.

United Kingdom Pat. No. 1561 869 discloses a cavaletto in the form of a horizontal pole, each end of which is permanently secured, by screwing or mortising, to a rectangular support plate disposed perpendicularly to the length of the pole. Each rectangular support plate has a recess, semi-circular in section, in the middle of each of its circumferential sides, and the end of the pole is secured in one of these recesses, with one half of the cross section of the pole received in the recess and the other half protruding. To vary the height of the pole, the cavaletto is rotated about the length of the pole. Thus the sides of the two plates to which the pole is attached may face upwards,downwards, or to either side, (as seen in side elevation), so that the pole is at an upper, lower or intermediate height. One of more such cavaletti may be used to build a horse jump.

An object of the present invention is to provide a pole support which enables a fence to be readily built and dismantled, which enables the height of the fence to be varied easily and quickly, which is safe in use, and which can be easily stored and transported.

SUMMARY OF THE INVENTION

The invention provides a device for use in supporting one end of an equestrian fence pole, the device comprising a block which is rectangular in cross section and which has three mutually perpendicular pairs of opposed faces, each face of at least two of the pairs of opposed faces having a centrally disposed transverse groove, for receiving one end of the pole when the block is placed on the ground or on top of another such block, the faces being so dimensioned that the block can be used to support the pole at one of two alternative heights.

The block of the invention is free standing, unlike the rectangular plates disclosed in United Kingdom Pat. No. 1561 869 which stand only as part of a cavaletto assembly comprising two such plates rigidly connected to one another by a pole. In equestrian fences built with blocks according to the invention, the poles are not secured in any way to the blocks but merely rest on the blocks. The blocks of the invention are easier to store, transport and lift than the assemblies disclosed in the above United Kingdom specification.

Advantageously, each face of all three pairs of opposed faces has a centrally disposed semi-cylindrical transverse groove, the faces being so dimensioned that the block can be used to support the pole at three alternative heights.

Advantageously, the grooves are so shaped and disposed that when when the block is placed upon another such block, the semi-cylindrical groove on the lower face of the block co-operates with the semi-cylindrical groove on the upper face of the other block to form a cylindrical socket for receiving one end of an equestrian fence pole.

In the device of the invention, the corners of the block are preferably rounded instead of angled. This is intended to reduce the risk of injury to a horse or rider hitting, or landing on, the block. This may be compared with the angled corners of the rectangular plates of the cavaletto, described in the above United Kingdom specification, which has been designed to reduce injury to a horse hitting the pole but is not concerned with the problem of a horse or rider hitting the pole support.

BRIEF DESCRIPTION OF THE DRAWINGS

The invention will now be described more particularly by way of example with reference to the accompanying drawings. In the drawings.

DESCRIPTION OF PREFERRED EMBODIMENT

Figure 1:
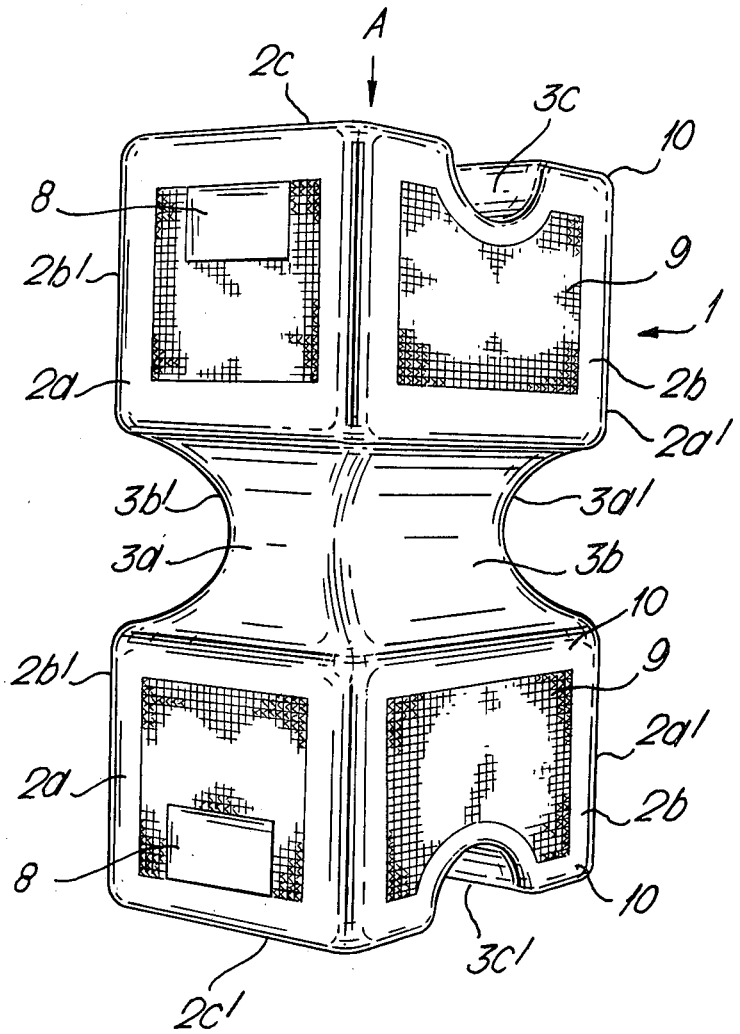
FIG. 1 shows a perspective view of one form of block.
Figure 2:
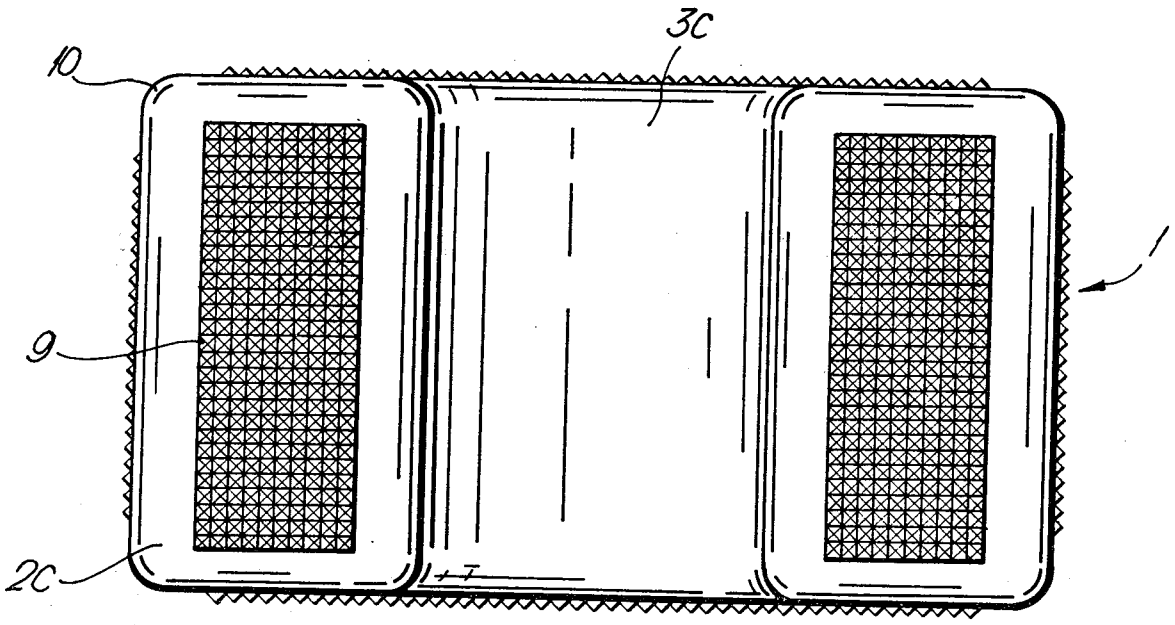
FIG. 2 shows an end view of the block, looking in the direction of arrow A of FIG. 1.

Referring first to FIGS. 1 and 2, the block, generally designated 1, comprises three mutually perpendicular pairs of opposed faces *2a, 2a'; 2b,2b'*; and *2c,2c'*. Each face has a centrally disposed approximately semi-cylindrical transverse groove, indicated by *3a,3a'; 3b,3b'*; and *3c,3c'* respectively. The lengths of each of the three dimensions of the block are all different to one another.

It would of course be possible to provide a block in which only two of the pairs of faces were provided with grooves and having the two corresponding dimensions different to one another.

Figure 3:
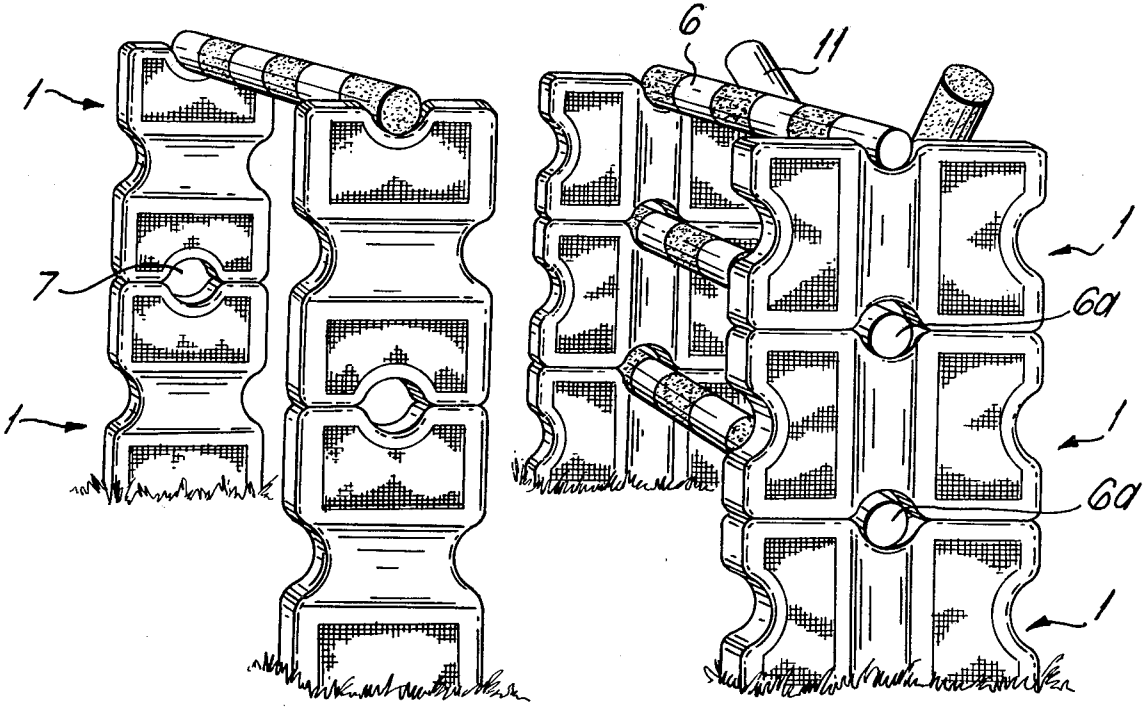
FIG. 3 shows an equestrian jump comprising two fences, constructed using blocks as shown in FIGS. 1 and 2.

Referring now to FIG. 3, the ends of the poles of the right hand fence are supported by resting three blocks 1 one on top of another. The ends of the topmost pole 6 rest in the grooves on the upper faces of the topmost blocks. The ends of the lower poles *6a* are located in the cylindrical sockets 7 defined by the co-operating semi-cylindrical grooves in the upper and lower faces of adjacent blocks. Two further poles 11, in an X-configuration, are shown leaning against the stacked blocks.

If a horse, when jumping, should stumble or fall and the horse or rider hit the stacked blocks, the individual blocks fall off one another. The likelihood of serious injury is thus considerably reduced. The fence can be quickly reassembled. If the horse hits only the topmost pole then the topmost pole and the two topmost blocks may be knocked over but not the entire fence.

The block 1 is provided with recesses 8 (see FIG. 1) which serve as hand-grips, for ease of handling. Each face of the block 1 has an anti-slip feature in the form of an array of squat pyramid shaped projections 9. When two blocks are placed one on top of the other the projections on the two contacting faces mate with one another, preventing the blocks from slipping too easily relative to one another. The corners 10 of the block 1 are rounded instead of angled for safety reasons.

Apart from its principal use in constructing horse jumps the block has other uses. A fenced-in area may be created using the blocks. A circular fenced-in area may be created by disposing a number of blocks in a circle, each block being one pole length apart from its neighbours, and then resting a corresponding number of poles each with one end or one block and the other end on a neighbouring block.

Trotting lanes, comprising a series of low obstacles, may also be constructed using the blocks. Each low obstacle is formed by resting one end of a pole on a block and the other end on the ground.

The blocks may also be used without poles for a variety of other purposes: for example, they can be used as stepping blocks to assist in mounting horses; as course markers or obstacles, in training horses; and as seats.

The block is made of high density polyethylene which is a clean durable material. The block is white, which is aesthetically pleasing. The block is hollow and is of a weight light enough to enable it to be lifted easily by one person and light enough not to cause injury when it falls but heavy enough not to be blown over too easily in the wind. The grooves measure six inches (=15 cm) across and two and a half inches (=6.5 cm) in depth, and can thus receive poles of conventional size. The dimensions of the block are twenty four inches (=60 cm), fifteen inches (=38 cm), and nine inches (=22 cm). These dimensions enable a wide range of different fence heights to be obtained. With two blocks, eitht different heights can be obtained. With four blocks, heights between two feet and five feet inclusive can be obtained in steps of three inches, as well as other heights outside this range.

The invention further provides a toy version (not shown) of the block, comprising a scaled down version thereof. A toy equestrian fence may be constructed from these scaled down blocks and from poles of corresponding size, and the height of the toy fence may be varied in the same manner as that of the full size fence.

One toy block according to the invention is made of wood and is provided with felt on each surface which serves to prevent blocks slipping too easily and also serves to prevent the blocks from scratching a table top or other surface on which they rest.

We claim:

1. A device for use in supporting one end of an equestrian fence pole, or for the like purposes, the device comprising a block which is rectangular in cross section and thereby has three mutually perpendicular pairs of opposed faces, at least one of the faces of each said pairs having a groove extending across the face, the groove being for receiving and supporting one end of the pole when the block is placed on the ground or on top of another such block, the three pairs of opposed faces being so dimensioned that the block can be used to support the pole at any one of three different heights selected by orienting the block with a face of a selected one of the pairs of faces facing upward.

2. A device according to claim 1, wherein at least one of the faces is provided with surface formations for cooperating with corresponding surface formations on an adjacent block so that when two such blocks are placed one on top of the other, the formations assist in holding the blocks in position in which the surface formations are in the form of an array of squat pyramid shaped projections.

3. A device according to claim 1 in which each groove is centrally disposed transversely of the respective face of the block.

4. A device according to claim 1 wherein each groove is semi-cylindrical.

5. A device according to claim 1 in which both faces of each pair of opposed faces have the grooves, and the grooves are so shaped and disposed that when the block is placed upon another such block, the groove on the upper face of the upper block is adpated to receive and to support one end of a pole and/or the groove on the lower face of the upper block cooperates with the groove on the upper face of the lower block to define a socket for receiving one end of another such pole.

6. A device according to claim 3, in which each groove is centrally disposed transversely of the respective face of the block.

7. A device according to claim 1 in which both faces of each pair of opposed faces have the grooves.

8. A device according to claim 7, in which each groove is centrally disposed transversely of the respective face of the block.

9. A device for use in supporting one end of an equestrian fence pole, or for the like purposes, the device comprising an elongated block of substantial thickness which is rectangular in at least one cross section and thereby has two mutually perpendicular pairs of opposed faces on any one of which the block is free-standing, each of the faces of each pair having a groove extending across the face, the groove being for receiving and supporting one end of the pole when the block is placed on the ground or on top of another such block and one of the grooved faces is facing upward, the two pairs of opposed faces being dimensionally different so that the block can be used to support the pole at one of two different heights selected by orienting the block with a face of a selected one of the pairs of dimensionally different faces facing upward whereby the pole may be first positioned at a lower height and elevated to substantially greater height in a second position with the elongated block in a vertical position.

* * * * *